US009042803B2

(12) United States Patent
Egusa et al.

(10) Patent No.: US 9,042,803 B2
(45) Date of Patent: May 26, 2015

(54) IMAGE TRANSFER DEVICE AND IMAGE FORMING APPARATUS

(71) Applicant: FUJI XEROX CO., LTD., Tokyo (JP)

(72) Inventors: Naoyuki Egusa, Kanagawa (JP); Tomoo Kobayashi, Kanagawa (JP); Tetsuro Kodera, Kanagawa (JP); Kaoru Torikoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/966,771

(22) Filed: Aug. 14, 2013

(65) Prior Publication Data

US 2014/0294472 A1 Oct. 2, 2014

(30) Foreign Application Priority Data

Mar. 27, 2013 (JP) ..... 2013-066103

(51) Int. Cl.

| | |
|---|---|
| ***G03G 15/20*** | (2006.01) |
| ***G03G 15/16*** | (2006.01) |
| ***G03G 15/24*** | (2006.01) |
| ***G03G 15/00*** | (2006.01) |

(52) U.S. Cl.

CPC ..... *G03G 15/161* (2013.01); *G03G 15/24* (2013.01); *G03G 15/6573* (2013.01); *G03G 2215/00481* (2013.01); *G03G 2221/1696* (2013.01)

(58) Field of Classification Search

USPC ..... 399/330, 335, 341, 342

See application file for complete search history.

(56) References Cited

U.S. PATENT DOCUMENTS

| | | | | |
|---|---|---|---|---|
| 4,242,566 | A * | 12/1980 | Scribner | 219/216 |
| 7,020,432 | B2 * | 3/2006 | Omata et al. | 399/400 |
| 7,076,195 | B2 * | 7/2006 | Sakai | 399/301 |
| 7,221,897 | B2 * | 5/2007 | Egusa et al. | 399/329 |
| 2003/0224169 | A1 | 12/2003 | Kobayashi et al. | |
| 2004/0126690 | A1 | 7/2004 | Kobayashi et al. | |

FOREIGN PATENT DOCUMENTS

| | | |
|---|---|---|
| JP | A-2005-28865 | 2/2005 |
| JP | A-2007-50689 | 3/2007 |
| JP | B2-4013658 | 11/2007 |
| JP | B2-4019921 | 12/2007 |

* cited by examiner

*Primary Examiner* — Clayton E LaBalle
*Assistant Examiner* — Warren K Fenwick
(74) *Attorney, Agent, or Firm* — Oliff PLC

(57) ABSTRACT

An image transfer device includes a transfer unit and a transport unit. The transfer unit that heats a layered body including a recording member, which is flexible and has an image recorded on a recording surface thereof, and a base member, onto which the image on the recording member is to be transferred, to transfer the image recorded on the recording surface onto the base member. The transfer unit transporting the layered body by rotating while being in contact with a back surface of the recording member on a side opposite to the side of the recording surface. The transport unit disposed upstream of the transfer unit in a transport direction of the layered body. The transport unit rotating while being in contact with the back surface of the recording member to transport the layered body to the transfer unit.

10 Claims, 9 Drawing Sheets

IMAGE TRANSFER DEVICE AND IMAGE FORMING APPARATUS

CROSS-REFERENCE TO RELATED APPLICATIONS

This application is based on and claims priority under 35 USC 119 from Japanese Patent Application No. 2013-066103 filed Mar. 27, 2013.

BACKGROUND

Technical Field

The present invention relates to an image transfer device and an image forming apparatus.

SUMMARY

According to an aspect of the invention, there is provided an image transfer device including a transfer unit and a transport unit. The transfer unit that heats a layered body including a recording member, which is flexible and has an image recorded on a recording surface thereof, and a base member, onto which the image on the recording member is to be transferred, to transfer the image recorded on the recording surface onto the base member. The transfer unit transporting the layered body by rotating while being in contact with a back surface of the recording member on a side opposite to the side of the recording surface. The transport unit disposed upstream of the transfer unit in a transport direction of the layered body. The transport unit rotating while being in contact with the back surface of the recording member to transport the layered body to the transfer unit.

BRIEF DESCRIPTION OF THE DRAWINGS

An exemplary embodiment of the present invention will be described in detail based on the following figures, wherein:

FIGS. 7A to 7C illustrate a case in which images are printed on both sides of a base member according to the exemplary embodiment, wherein FIG. 7A shows a state in which a recording member having an image for a first side printed thereon is placed on a stacking unit; FIG. 7B shows a state in which the base member is stacked on the recording member in the state shown in FIG. 7A; and FIG. 7C shows a state in which a recording member having an image for a second side printed thereon is stacked on the base member in the state shown in FIG. 7B;

FIG. 11B is a perspective view of a transfer film in a bent state.

DETAILED DESCRIPTION

An exemplary embodiment of the present invention will be described with reference to the drawings. However, the present invention is not limited to the following exemplary embodiments.

To facilitate understanding of the following description, the front-back direction, the left-right direction, and the up-down direction are defined as the X-axis direction, the Y-axis direction, and the Z-axis direction, respectively, in each figure. In addition, directions shown by arrows X, -X, Y, -Y, Z, and -Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "x" marks therein show the direction from front to back with respect to the sides illustrated in the figures.

In each figure, components other than those necessary for explanation are omitted to facilitate understanding.

Figure 1:
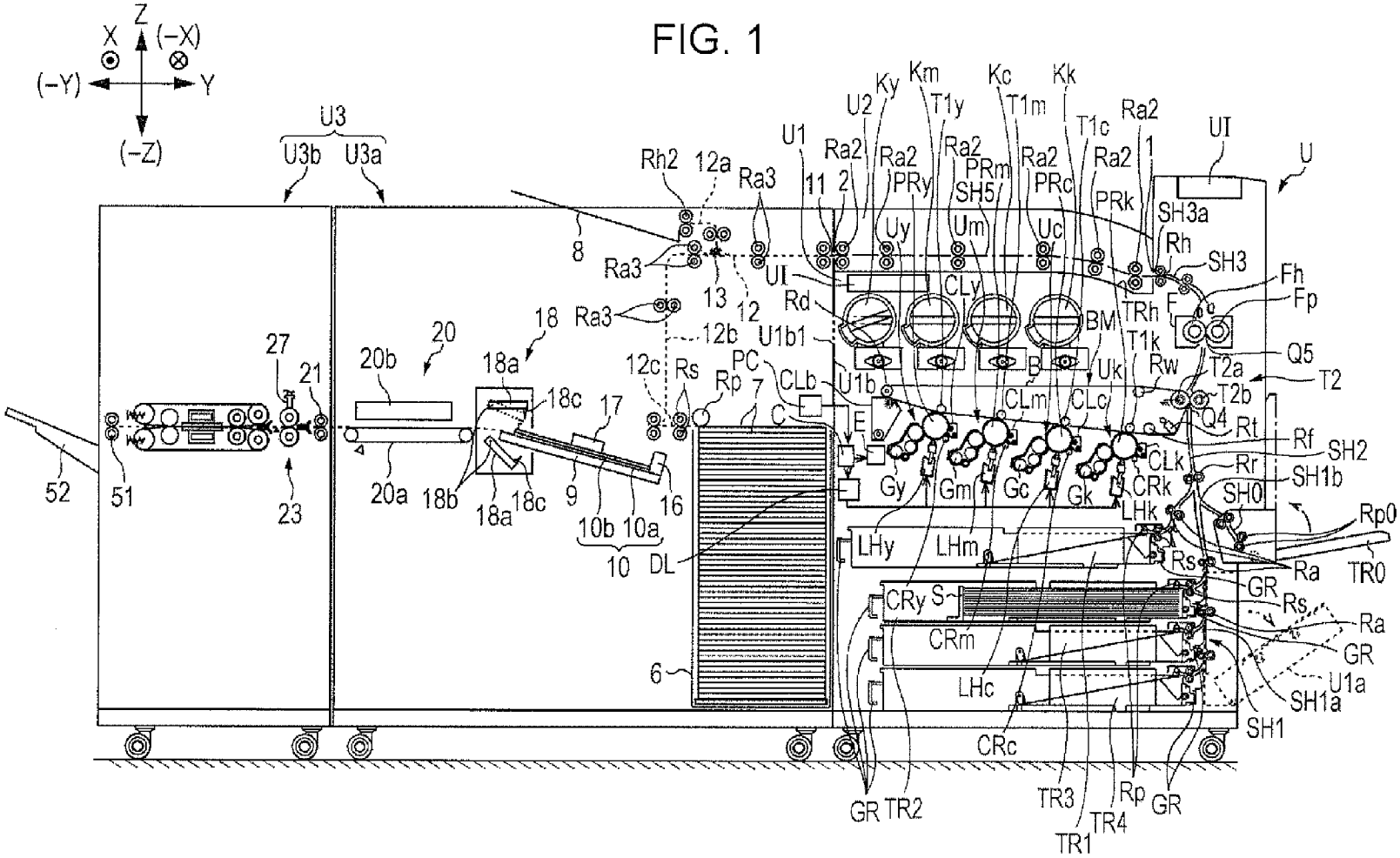
FIG. 1 illustrates the overall structure of an image forming apparatus according to an exemplary embodiment of the present invention.

FIG. 1 illustrates the overall structure of an image forming apparatus according to an exemplary embodiment of the present invention.

Referring to FIG. 1, a printer U, which is an example of an image forming apparatus according to the exemplary embodiment of the present invention, includes a printer body U1 as an example of an apparatus body. The printer U is electrically connected to a personal computer PC, which is an example of an image information transmitting device. The printer U includes a controller C capable of receiving the image information transmitted from the personal computer PC.

The controller C converts the image information input from the personal computer PC into yellow (Y), magenta (M), cyan (C), and black (K) image information used to form latent images. The controller C outputs the converted image information to a writing circuit DL at a preset time.

The controller C outputs only black (K) image information to the writing circuit DL when a single-color image, that is, a monochrome image is to be formed.

The writing circuit DL outputs signals corresponding to the input image information to LED heads LHy, LHm, LHc, and LHk, which are an example of exposure devices for the respective colors, at a preset time. In the exemplary embodiment, each of the LED heads LHy to LHk includes an LED array in which LEDs, which are an example of light-emitting elements, are linearly arranged in an image width direction. The LED heads LHy to LHk emit light from the LEDs in accordance with the input signals. Thus, the LED heads LHy to LHk output writing light in accordance with the input signals.

Figure 2:
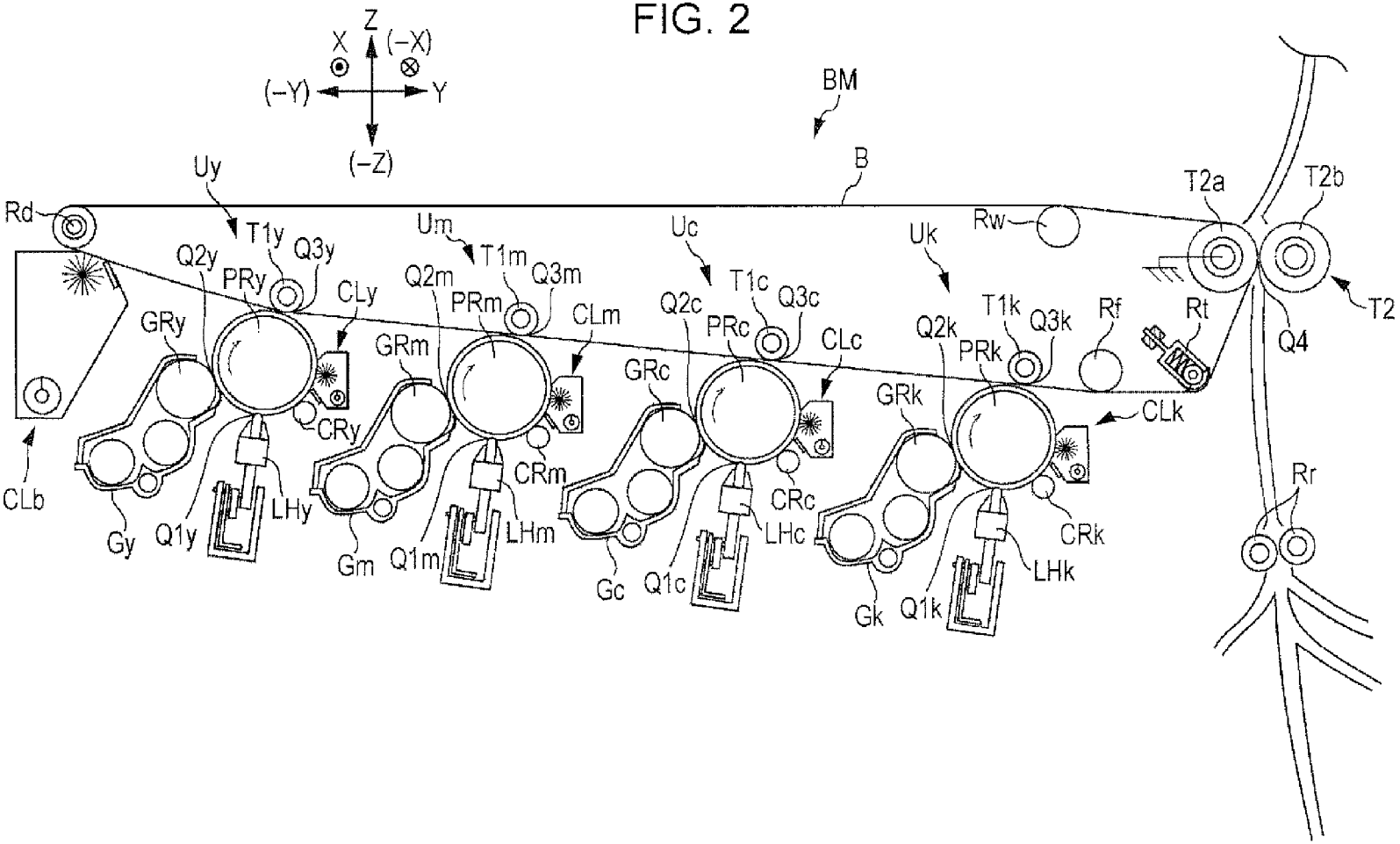
FIG. 2 is an enlarged view of a part of the image forming apparatus according to the exemplary embodiment.

FIG. 2 is an enlarged view of a part of the image forming apparatus according to the exemplary embodiment.

Referring to FIGS. 1 and 2, photoconductors PRy, PRm, PRc, and PRk, which are an example of image carriers, are disposed above the respective LED heads LHy to LHk.

Charging rollers CRy, CRm, CRc, and CRk, which are an example of chargers, are respectively arranged upstream of the LED heads LHy to LHk in a rotation direction of the photoconductors PRy, PRm, PRc, and PRk so as to be in contact with the photoconductors Pry to PRk. Developing devices Gy, Gm, Gc, and Gk are respectively arranged downstream of the LED heads LHy to LHk in the rotation direction of the photoconductors Pry to PRk. First transfer rollers T1*y*, T1*m*, T1*c*, and T1*k*, which are an example of first transfer members, are respectively arranged downstream of the developing devices Gy to Gk in the rotation direction of the photoconductors Pry to PRk. Photoconductor cleaners CLy, CLm, CLc, and CLk, which are an example of image carrier cleaners, are respectively arranged downstream of the first transfer rollers T1*y* to T1*k* in the rotation direction of the photoconductors Pry to PRk.

The photoconductor PRy, the charging roller CRy, the LED head LHy, the developing device Gy, the first transfer roller T1*y*, and the photoconductor cleaner CLy for yellow form a yellow image forming unit Uy, which is an example of a yellow visible image forming device according to the exemplary embodiment which forms yellow toner images as an example of visible images. Similarly, the photoconductors PRm, PRc, and PRk, the charging rollers CRm, CRc, and CRk, the LED heads LHm, LHc, and LHk, the developing devices Gm, Gc, and Gk, the first transfer rollers T1*m*, T1*c*, and T1*k*, and the photoconductor cleaners CLm, CLc, and CLk form magenta, cyan, and black image forming units Um, Uc, and Uk.

A belt module BM, which is an example of an intermediate transfer device, is disposed above the photoconductors PRy to PRk. The belt module BM includes an intermediate transfer belt B, which has the shape of an endless belt, as an example of an intermediate transfer body. The intermediate transfer belt B is rotatably supported by a belt driving roller Rd which is an example of a driving member, a tension roller Rt which is an example of a tension-applying member, a walking roller Rw which is an example of a deviation correcting member, an idler roller Rf which is an example of a driven member, a backup roller T2*a* which is an example of a member that opposes a second transfer region, and the first transfer rollers T1*y*, T1*m*, T1*c*, and T1*k*.

A second transfer roller T2*b*, which is an example of a second transfer part, is disposed so as to oppose the backup roller T2*a* with the intermediate transfer belt B interposed therebetween. In the exemplary embodiment, the backup roller T2*a* is grounded and the second transfer roller T2*b* receives a second transfer voltage having a polarity opposite to the charge polarity of toner from a power supply circuit E. The backup roller T2*a* and the second transfer roller T2*b* form a second transfer member T2 according to the exemplary embodiment. The region in which the second transfer roller T2*b* and the intermediate transfer belt B contact each other serves as a second transfer region Q4.

A belt cleaner CLb, which is an example of an intermediate transfer body cleaner, is disposed downstream of the second transfer region Q4 in a rotation direction of the intermediate transfer belt B.

The first transfer rollers T1*y* to T1*k*, the intermediate transfer belt B, and the second transfer member T2 form a transfer device T1+T2+B according to the exemplary embodiment. The image forming units Uy to Uk and the transfer device T1+T2+B form an image recording unit Uy–Uk+T1+T2+B according to the exemplary embodiment.

Referring to FIG. 1, four pairs of left and right guide rails GR, which are an example of guide members, are disposed below the image forming units Uy to Uk. Feed trays TR1 to TR4, which are an example of medium containers, are supported by the respective pairs of guide rails GR so as to be movable in a front-rear direction. Recording sheets S, which are an example of media, are contained in the feed trays TR1 to TR4.

Pick-up rollers Rp, which are an example of pick-up members, are arranged at the upper right of the respective feed trays TR1 to TR4. Separation rollers Rs, which are an example of separation members, are arranged downstream of the respective pick-up rollers Rp in a transport direction of the recording sheets S. A feed path SH1, which is an example of a medium transport path, is arranged downstream of the separation rollers Rs in the transport direction of the recording sheets S so as to extend upward. Plural transport rollers Ra, which are an example of transport members, are arranged along the feed path SH1.

Registration rollers Rr, which are an example of transport time adjusters, are disposed upstream of the second transfer region Q4 on the feed path SH1.

A manual feed tray TR0, which is an example of a manual feed unit, is disposed on the right side of the uppermost feed tray TR1. The manual feed tray TR0 is provided with manual feed rollers Rp0, which are an example of manual feed members.

A fixing device F is disposed downstream of the second transfer region Q4 in the transport direction of the sheets S. The fixing device F includes a heating roller Fh, which is an example of a heating fixing member, and a pressure roller Fp, which is an example of a pressing heating member. The region in which the heating roller Fh and the pressure roller Fp contact each other serves as a fixing region Q5.

An output path SH3, which is an example of a transport path, is disposed above the fixing device F. The output path SH3 extends to an output tray TRh, which is formed on the top surface of the printer body U1 as an example of a media output unit. Output rollers Rh, which are an example of a media transport member, are disposed at an outlet SH3*a* provided at the downstream end of the output path SH3.

Description of Functions of Printer

When the printer U according to the exemplary embodiment having the above-described structure receives the image information from the personal computer PC, the controller C converts the image information into Y, M, C, and K image information. The converted image information is output to the writing circuit DL. The writing circuit DL controls the LED heads LHy to LHk in accordance with the input image information, and the writing light is emitted accordingly.

The photoconductors PRy to PRk rotate when an image forming operation is started. The power supply circuit E applies a charging voltage to the charging rollers CRy to CRk. Accordingly, the surfaces of the photoconductors PRy to PRk are charged by the charging rollers CRy to CRk, respectively. Electrostatic latent images are formed on surfaces of the charged photoconductors PRy to PRk at writing positions Q1*y*, Q1*m*, Q1*c*, and Q1*k* by the writing light emitted from the LED heads LHy to LHk. The electrostatic latent images on the photoconductors PRy to PRk are developed into toner images, which are an example of visible images, in developing regions Q2*y*, Q2*m*, Q2*c*, and Q2*k* by the developing devices Gy, Gm, Gc, and Gk.

The toner images are transported to the first transfer regions Q3*y*, Q3*m*, Q3*c*, and Q3*k*, where the toner images come into contact with the intermediate transfer belt B, which is an example of an intermediate transfer body. The first transfer rollers T1*y* to T1*k* are disposed behind the intermediate transfer belt B in the first transfer regions Q3*y*, Q3*m*, Q3*c*, and Q3*k*. The power supply circuit E, which is controlled by the controller C, applies a first transfer voltage having a polarity opposite to the charge polarity of the toner to each of the first transfer rollers T1*y* to T1*k* in advance at a preset time. Accordingly, the toner images on the photoconductors PRy to PRk are transferred onto the intermediate transfer belt B by the first transfer rollers T1*y* to T1*k*. In the case where toner images of respective colors are formed, a first toner image is transferred onto the intermediate transfer belt B in the most upstream first transfer region, and then downstream toner images are superposed onto the first toner image.

Substances that remain on or adhere to the photoconductors PRy to PRk after the first transfer process are removed by the photoconductor cleaners CLy to CLk. The surfaces of the photoconductors PRy to PRk that have been cleaned are charged again by the charging rollers CRy to CRk.

A single-color toner image or multicolor toner images that have been transferred onto the intermediate transfer belt B by the first transfer rollers T1*y* to T1*k* in the first transfer regions Q3*y* to Q3*k* are transported to the second transfer region Q4.

A sheet S on which the images are to be recorded is fed by the pick-up roller Rp of one of the feed trays TR1 to TR4 that is used. When the sheet S is fed by the pick-up roller Rp while being stacked on other sheets S, the sheets S are separated from each other by the separation rollers Rs. The sheet S that has been separated from the other sheets by the separation rollers Rs is transported along the feed path SH1 by the transport rollers Ra. The sheet S that has been transported along the feed path SH1 is transported to the registration rollers Rs.

In the case where a sheet S placed on the manual feed tray TR0 is to be used, the manual feed rollers Rp0 transport the sheet S on the manual feed tray TR0 to the registration rollers Rr along a manual feed transport path SH0.

The registration rollers Rr transport the sheet S to the second transfer region Q4 at the time when the toner images formed on the intermediate transfer belt B reach the second transfer region Q4. The power supply circuit E applies a second transfer voltage having a polarity opposite to the charge polarity of the toner to the second transfer roller T2*b*. Thus, the toner images on the intermediate transfer belt B are transferred onto the sheet S from the intermediate transfer belt B.

After the second transfer process, the intermediate transfer belt B is cleaned by the belt cleaner CLb, which is an example of an intermediate transfer body cleaner.

The toner images that have been transferred onto the recording sheet S in the second transfer process are thermally fixed to the sheet S when the sheet S passes through the fixing region Q5.

The recording sheet S to which the images have been fixed is transported along the output path SH3. In the case where a relay unit U2, which will be described below, is not placed on the output tray TRh, the sheet S that has been transported along the output path SH3 is output to the output tray TRh by the output rollers Rh.

Description of Relay Unit U2

Referring to FIG. 1, the relay unit U2, which is an example of a medium transport device, is detachably supported on the output tray TRh of the printer U according to the exemplary embodiment.

A relay path SH5, which is an example of a medium transport path, is provided in the relay unit U2. The relay path SH5 has an inlet 1 at one end thereof that is connected to the sheet outlet SH3*a* of the printer body U1. The recording sheet S that has been output by the output rollers Rh is inserted into the inlet 1. Relay rollers Ra2, which are an example of medium transport members, are arranged on the relay path SH5. The intermediate path SH5 has an outlet 2 for a post processing device at a downstream end thereof in the transport direction of the sheet S.

Description of Collating Device of Image Transfer Device

In FIG. 1, an image transfer device U3 is disposed on the right side of the printer U. The image transfer device U3 according to the exemplary embodiment includes a collating device U3*a* that is disposed adjacent to the relay unit U2 as an example of a stacking section.

A card tray 6, which is an example of a second medium container, is disposed in a lower right section of the collating device U3*a*. Card base members 7, which are an example of base members or second media, are stacked on the card tray 6. IC chips (not shown), which are an example of information storage media, are mounted in the card base members 7. The IC chips according to the exemplary embodiment are so-called IC tags, which are chips capable of performing radio communication. Therefore, the IC chips allow non-contact information transmission/reception. Information regarding the media, such as the type of the material of the card base members 7 and the size of the card base members 7, is stored in advance in the IC chips according to the exemplary embodiment.

A second output tray 8, which is an example of a second medium output unit, is provided at the top of the collating device U3*a*.

A compile tray 9, which is an example of a stacking unit body, is provided on the left side of the card tray 6 in the collating device U3*a*. The compile tray 9 according to the exemplary embodiment is capable of receiving the card base members 7 and the sheets S on which the toner images have been formed by the printer body U1.

Figure 3A:
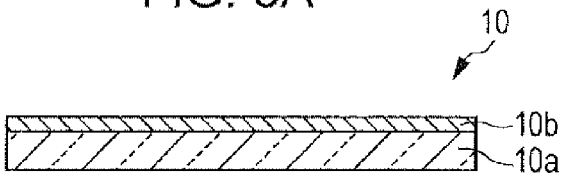
FIG. 3A illustrates a recording member according to the exemplary embodiment.
Figure 3B:
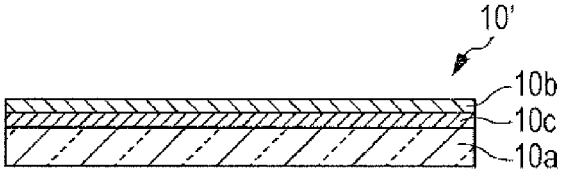
FIG. 3B illustrates a modification of the recording member.

FIG. 3A illustrates a recording member according to the exemplary embodiment, and FIG. 3B illustrates a modification of the recording member.

In the exemplary embodiment, transfer films or marking on everything (MOE) films, which are examples of media or recording members, may be used as the sheets S. Referring to FIG. 3A, a transfer film 10 according to the exemplary embodiment includes a film-shaped base layer 10*a*. An image receiving layer 10*b* is supported on a surface of the base layer 10*a*. A surface of the image receiving layer 10*b* serves as a recording surface on which an image is recoded. The base layer 10*a* may be made of, for example, a PET film having a thickness of 80 μm. The image receiving layer 10*b* may be made of, for example, a known toner image receiving layer having a thickness of several micrometers. The toner image receiving layer may have, for example, either of the structures described in Japanese Patent Nos. 4013658 and 4019921, and detailed descriptions thereof are thus omitted.

As illustrated in FIG. 3B, a transfer film 10' having a protective layer 10*c* interposed between the base layer 10*a* and the image receiving layer 10*b* may instead be used. The collating device U3*a* includes an inlet 11 connected to the outlet 2 of the intermediate path SH5 on the side adjacent to the relay unit U2. A transport path 12 that extends leftward from the inlet 11 is disposed in the collating device U3*a*. The transport path 12 includes an ejection path 12*a* that extends to the second output tray 8 located thereabove as an example of an ejection transport path and a reversing transport path. Output rollers Rh2, which are an example of output members, are arranged at the downstream end of the ejection path 12*a* so as to correspond to the second output tray 8. The transport path 12 also includes a stacking path 12*b* that branches from the ejection path 12*a* and extends toward the compile tray 9 as an example of a medium transport path. A gate 13, which is an example of a member for switching a medium transport direction, is disposed at a position where the ejection path 12*a* and the stacking path 12*b* branch. The transport path 12 also includes a base-member supply path 12*c* that extends from the card tray 6 to the compile tray 9 and is connected to the stacking path 12*b* as an example of a medium transport path.

Plural transport rollers Ra3, which are an example of medium transport members, are arranged on the transport path 12. A pick-up roller Rp and separation rollers Rs, which have structures similar to those of the pick-up roller Rp and the separation rollers Rs for each of the feed trays TR1 to TR4, are arranged at the upper left of the card tray 6.

The compile tray 9 according to the exemplary embodiment is inclined upward toward the left, that is, toward the downstream side in the medium transport direction.

A stopper 16 that extends upward is provided at the right edge of the compile tray 9 as an example of a stopper member. The stopper 16 according to the exemplary embodiment is supported so as to be movable in the transport direction in accordance with the length of the sheets S stacked on the compile tray 9 in the transport direction. The position of the stopper 16 in the transport direction is controllable by a drive mechanism including a motor, a gear, etc. (not shown). The stopper 16 contacts the trailing edges of the sheets S stacked on the compile tray 9 in the transport direction to align the trailing edges of the sheets S. The stopper 16 according to the exemplary embodiment also has a function of transporting the sheets S downstream in the transport direction by moving downstream while the sheets S are stacked on the compile tray 9.

A tamper 17, which is an example of a tamping member, is supported at the center of the compile tray 9 in the left-right direction. The tamper 17 is supported so as to be movable in the front-rear direction. The tamper 17 aligns the edges of the sheets S stacked on the compile tray 9 in the front-rear direction by coming into contact with and moving away from the edges of the sheets S in the front-rear direction.

A provisional fastening device 18 is supported at the left end of the compile tray 9. The provisional fastening device 18 includes arms 18*a* located above and below the compile tray 9 as an example of movable members. The arms 18*a* are rotatable around respective rotation centers 18*b*. Heating units 18*c* are supported at the ends of the respective arms 18*a*. In the exemplary embodiment, the provisional fastening device 18 is provided at each of two positions that are spaced from each other by a preset interval in the front-rear direction.

To provisionally fasten the sheets S stacked on the compile tray 9 together, the arms 18*a* of each provisional fastening device 18 move from the position shown by the solid lines to the position shown by the dashed lines in FIG. 1, and the heating units 18*c* apply heat to the sheets S. As a result, the sheets S are fused together at two positions in the front-rear direction at which the heat has been applied. Thus, the provisional fastening devices 18 according to the exemplary embodiment are capable of forming a layered body 19 in which a card base member 7 and a transfer film or films 10 are stacked and provisionally fastened together at two positions in the front-rear direction.

An encoder unit 20, which is an example of a reading unit, is disposed on the left side of the compile tray 9.

The encoder unit 20 according to the exemplary embodiment includes an endless transport belt 20*a* as an example of a transport member. A card reader 20*b*, which is an example of a reading member, is disposed above the transport belt 20*a*. The card reader 20*b* is capable of transmitting and receiving information to and from the IC chip mounted in the card base member 7 through non-contact radio communication. Thus, the card reader 20*b* is capable of reading the information stored in the IC chip through non-contact communication.

Figure 4:
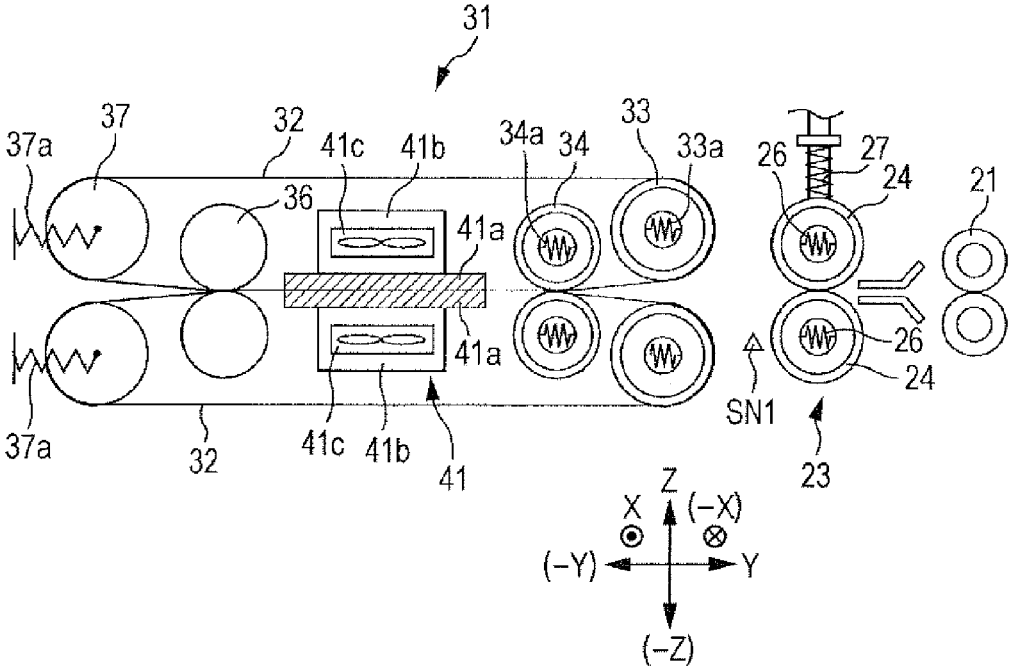
FIG. 4 illustrates a part of a transfer device body included in an image transfer device according to the exemplary embodiment.

FIG. 4 illustrates a part of a transfer device body U3*b* included in the image transfer device according to the exemplary embodiment.

The transfer device body U3*b* is disposed at the left side of the collating device U3*a*. The transfer device body U3*b* includes cleaning rollers 21, which are an example of cleaning members, at an upstream side thereof in the medium transport direction in which the layered body 19 is transported.

A warming device 23, which is an example of a transport unit and a warming member, is disposed downstream of the cleaning rollers 21 in the medium transport direction. The warming device 23 includes a pair of upper and lower preheat rollers 24 as an example of second rotary members. Each preheat roller 24 has a hollow cylindrical shape that extends in the front-rear direction. Heaters 26, which are an example of second heat sources, are disposed in the respective preheat rollers 24. The heaters 26 extend in the front-rear direction.

The upper preheat roller 24 is provided with a coil spring 27 as an example of a second pressing member. The coil spring 27 according to the exemplary embodiment presses the upper preheat roller 24 against the lower preheat roller 24 at a preset pressure.

A sheet sensor SN1, which is an example of a medium detecting member, is disposed downstream of the warming device 23 in the medium transport direction.

A transfer unit 31 is disposed downstream of the sheet sensor SN1 in the medium transport direction. The transfer unit 31 according to the exemplary embodiment includes a pair of upper and lower transfer belts 32 as an example of endless rotary members. Each transfer belt 32 is rotatably supported by an auxiliary heat roller 33 which is an example of an auxiliary heating member, a heat roller 34 which is an example of a first rotary member and a heating member, a support roller 36 which is an example of a heating member, and a tension roller 37 which is an example of a tension-applying member.

The pair of upper and lower auxiliary heat rollers 33 are disposed downstream of the preheat rollers 24 in the medium transport direction. The pair of upper and lower auxiliary heat rollers 33 are spaced from each other in the up-down direction so that the transfer belts 32 do not contact each other at the position of the auxiliary heat rollers 33. Heaters 33*a*, which are an example of heating elements, are supported in the respective auxiliary heat rollers 33.

The pair of upper and lower heat rollers 34 are disposed downstream of the auxiliary heat rollers 33 in the medium transport direction. The pair of upper and lower heat rollers 34 are pressed against each other at a preset pressure with the transfer belts 32 interposed therebetween. Therefore, the transfer belts 32 contact each other at the position of the heat rollers 34. Heaters 34*a*, which are an example of first heat sources, are supported in the respective heat rollers 34.

The pair of upper and lower support rollers 36 are disposed downstream of the heat rollers 34 in the medium transport direction. The pair of upper and lower support rollers 36 are pressed against each other at a preset pressure with the transfer belts 32 interposed therebetween. Therefore, the transfer belts 32 are in contact with each other in a region from the position of the heat rollers 34 to the position of the support rollers 36.

The pair of upper and lower tension rollers 37 are disposed downstream of the support rollers 36 in the medium transport direction. Similar to the auxiliary heat rollers 33, the pair of upper and lower tension rollers 37 are spaced from each other in the up-down direction. Therefore, the transfer belts 32 do not contact each other at the position of the tension rollers 37. The tension rollers 37 are urged by springs 37*a*, which are an example of elastic members, in a direction for applying a tension to the transfer belts 32.

A cooling device 41, which is an example of a cooling unit, is disposed between the heat rollers 34 and the support rollers 36 in the medium transport direction. The cooling device 41 according to the exemplary embodiment includes contact portions 41*a* that contact the inner peripheral surfaces of the respective transfer belts 32. Heat sinks 41*b*, which are an example of heat dissipating elements, are formed on the respective contact portions 41*a*. The cooling device 41 also includes fans 41*c* as an example of blowing members. The fans 41*c* blow cooling air toward the heat sinks 41*b* during a transferring operation.

In the transfer unit 31 according to the exemplary embodiment, the temperature of the heaters 34*a* is set so that a toner image formed on a transfer film 10 may be transferred onto the surface of the card base member 7 when the transfer film 10 and the card base member 7 pass between the heat rollers 34.

In the exemplary embodiment, toner that melts and is transferred from the transfer film 10 to the card base member 7 at about 90° C. is used. Accordingly, in the exemplary embodiment, to provide a sufficient allowance, that is, a margin, with respect to 90° C. at which the toner melts, the temperature of the heaters 34*a* is set so that the temperature of the layered body 19 may be increased to around 110° C. In the exemplary embodiment, the temperature of the layered body 19 is about 20° C. lower than that of the heaters 34*a*, and therefore the temperature of the heaters 34*a* is set to 130° C.

In the transfer unit 31 according to the exemplary embodiment, the temperature of the heaters 33*a* of the auxiliary heat rollers 33 is set so that the transfer belts 32 are heated at a location upstream of the heat rollers 34 in the rotation directions of the transfer belts 32. In the exemplary embodiment, the temperature of the heaters 33*a* is set to, for example, 90° C. so that the temperature of the transfer film 10 is about 70° C., at which the toner does not melt, even when the transfer film 10 comes into contact with the transfer belts 32.

In the transfer unit 31 according to the exemplary embodiment, the temperature of the heaters 26 is, for example, set so that when the layered body 19 passes between the preheat rollers 24, the temperature of the layered body 19 is lower than 90° C., which is the lower temperature limit at which the toner image formed on the transfer film 10 is transferred onto the card base member 7.

In particular, in the exemplary embodiment, the temperature of the heaters 26 is set so that the temperature of the layered body 19 is lower than the glass transition temperature of the card base member 7.

In the exemplary embodiment, the glass transition temperature of the card base member 7 is, for example, 68° C. Accordingly, the temperature of the heaters 26 is set to 80° C., so that the temperature of the layered body 19 is 60° C. when the layered body 19 passes between the preheat rollers 24.

In the exemplary embodiment, the pressing force applied between the preheat rollers 24 by the coil spring 27 is set on the basis of the contact pressure applied between the heat rollers 34 and the rigidity of the card base member 7 so that the card base member 7 is not bent in the region between the preheat rollers 24 and the heat rollers 34. In other words, the contact pressure is set so that when a force that tries to bend the card base member 7 is applied while the card base member 7 is in contact with the preheat rollers 24, the card base member 7 slips between the preheat rollers 24 instead of being bent.

Ejection rollers 51, which are an example of ejecting members, are disposed downstream of the cooling device 41 in the medium transport direction.

A third output tray 52, which is an example of a medium receiving unit, is supported on the left side of the transfer device body U3*b*. The layered body 19 that has been transported by the ejection rollers 51 is ejected to the third output tray 52.

Controller of Exemplary Embodiment

Figure 5:
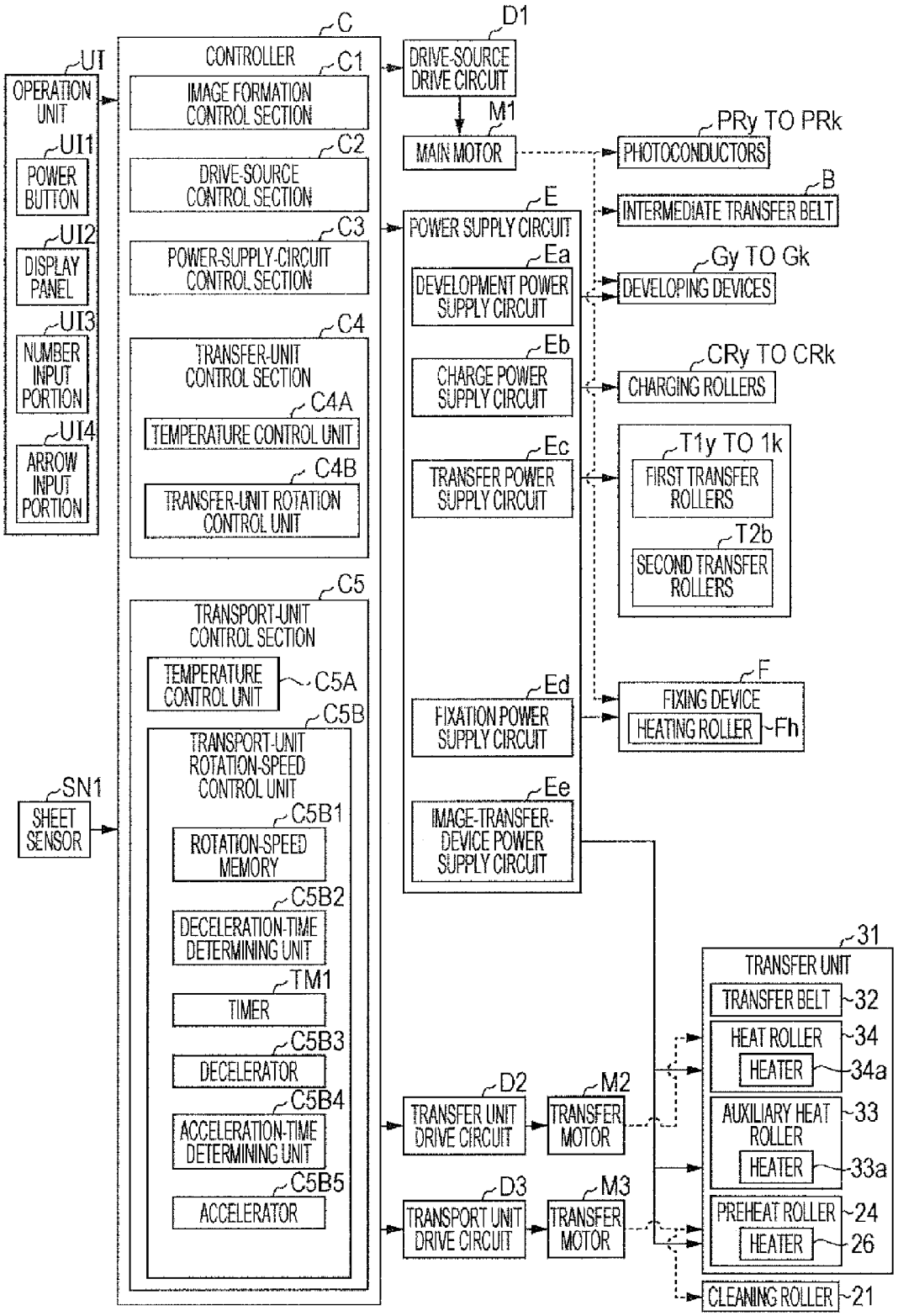
FIG. 5 is a block diagram illustrating the functions of a controller included in the image forming apparatus according to the exemplary embodiment.

FIG. 5 is a block diagram illustrating functions provided by the controller C included in the image forming apparatus U according to the exemplary embodiment.

Referring to FIG. 5, the controller C of the printer body U1 includes an input-output interface I/O through which signals are input from and output to an external device. The controller C includes a read-only memory (ROM) in which programs, information, etc., used to perform necessary processes are stored. The controller C also includes a random access memory (RAM) in which necessary data is temporarily stored. The controller C also includes a central processing unit (CPU) that performs processes in accordance with the programs stored in the ROM or the like. The controller C according to the exemplary embodiment is formed of a so-called microcomputer, which is a small information processor. The controller C is capable of performing various functions by executing the programs stored in the ROM or the like.

Signal Output Elements Connected to Controller C of Printer Body U1

The controller C of the printer body U1 receives signals output from signal output elements, such as the operation unit UI and the sheet sensor SN1.

The operation unit UI includes a power button UI1, which is an example of a power supply unit, a display panel UI2, which is an example of a display unit, a number input portion UI3, and an arrow input portion UI4.

The sheet sensor SN1 detects the layered body 19 that has been transported to a location downstream of the preheat rollers 24.

Elements to be Controlled Connected to Controller C of Printer Body U1

The controller C of the printer body U1 is connected to a drive-source drive circuit D1, a transfer unit drive circuit D2, a transport unit drive circuit D3, the power supply circuit E, and other elements to be controlled that are not illustrated. The controller C outputs control signals to the circuits D1 to D3 and E and other elements.

D1: Drive-Source Drive Circuit

The drive-source drive circuit D1 causes a base motor M1, which is an example of a drive source, to rotate the photoconductors PRy to PRk and the intermediate transfer belt B.

D2: Transfer Unit Drive Circuit

The transfer unit drive circuit D2 causes a transfer motor M2, which is also an example of a drive source, to drive the transfer belts 32 through the heat rollers 34.

D3: Transport Unit Drive Circuit

The transport unit drive circuit D3 causes a transport motor M3, which is also an example of a drive source, to drive the preheat rollers 24.

E: Power Supply Circuit

The power supply circuit E includes a development power supply circuit Ea, a charge power supply circuit Eb, a transfer power supply circuit Ec, a fixation power supply circuit Ed, and an image-transfer-device power supply circuit Ee.

Ea: Development Power Supply Circuit

The development power supply circuit Ea applies a developing voltage to developing rollers of the developing devices Gy to Gk.

Eb: Charge Power Supply Circuit

The charge power supply circuit Eb applies a charge voltage for charging the surfaces of the photoconductors PRy to PRk to the charging rollers CRy to CRk.

Ec: Transfer Power Supply Circuit

The transfer power supply circuit Ec applies a transfer voltage to the first transfer rollers T1*y* to T1*k* and the second transfer roller T2*b*.

Ed: Fixation Power Supply Circuit

The fixation power supply circuit Ed supplies heating electric power to the heating roller Fh of the fixing device F.

Ee: Image-Transfer-Device Power Supply Circuit

The image-transfer-device power supply circuit Ee supplies electric power to the preheat rollers 24, the auxiliary heat rollers 33, and the heat rollers 34 of the image transfer device U3.

Functions of Controller C of Printer Body U1

The controller C of the printer body U1 performs processes corresponding to the signals input from the signal output elements and outputs control signals to the elements to be controlled. Specifically, the controller C functions as the following sections.

C1: Image Formation Control Section

An image formation control section C1 executes a job, that is, an image forming operation, by controlling operations of components of the printer U, times at which voltages are applied, etc., in accordance with the image information input from the personal computer PC.

C2: Drive-Source Control Section

A drive-source control section C2 controls the operation of the photoconductors PRy to PRk by controlling the operation of the base motor M1 through the drive-source drive circuit D1.

C3: Power-Supply-Circuit Control Section

A power-supply-circuit control section C3 controls the voltages applied to the components and the electric power supplied to the components by controlling the power supply circuits Ea to Ee.

C4: Transfer-Unit Control Section

A transfer-unit control section C4 includes a temperature control unit C4A and a transfer-unit rotation control unit C4B, and controls the rotations and temperatures of the components included in the transfer unit 31.

C4A: Temperature Control Unit

The temperature control unit C4A controls the temperatures of the heaters 33*a* and 34*a* through the power supply circuit E. The temperature control unit C4A according to the exemplary embodiment adjusts the temperatures of the auxiliary heat rollers 33 and the heat rollers 34 to preset temperatures by controlling the on-off states of the heaters 33*a* and 34*a* on the basis of detection results obtained by temperature sensors (not shown).

C4B: Transfer-Unit Rotation Control Unit

The transfer-unit rotation control unit C4B controls the rotation of the transfer belts 32 through the transfer unit drive circuit D2. The transfer-unit rotation control unit C4B according to the exemplary embodiment starts to rotate the transfer belts 32 at a preset rotation speed when a job is started, and stops the rotation of the transfer belts 32 when the job is finished.

C5: Transport-Unit Control Section

The transport-unit control section C5 includes a temperature control unit C5A and a transport-unit rotation-speed control unit C5B, and controls the rotations and temperatures of the components of the warming device 23.

C5A: Temperature Control Unit

The temperature control unit C5A controls the temperature of the preheat rollers 24 through the power supply circuit E. The temperature control unit C5A according to the exemplary embodiment adjusts the temperature of the preheat rollers 24 to a preset temperature by controlling the on-off state of the heaters 26 included in the preheat rollers 24 on the basis of a detection result obtained by a temperature sensor (not shown).

C5B: Transport-Unit Rotation-Speed Control Unit

The transport-unit rotation-speed control unit C5B includes a rotation-speed memory C5B1, a deceleration-time determining unit C5B2, a timer TM1, a decelerator C5B3, an acceleration-time determining unit C5B4, and an accelerator C5B5, and controls the rotation speed of the preheat rollers 24.

C5B1: Rotation-Speed Memory

The rotation-speed memory C5B1 stores the rotation speed of the preheat rollers 24. The rotation-speed memory C5B1 according to the exemplary embodiment stores a high rotation speed V1, which is an example of a first speed, and a low rotation speed V2, which is an example of a second speed. In the exemplary embodiment, the low rotation speed V2 is set to a rotation speed of the preheat rollers 24 at which the transport speed of the layered body 19 is equal to or substantially equal to the transport speed of the transfer belts 32. The high rotation speed V1 is set to a rotation speed higher than the low rotation speed V2 in advance. In the exemplary embodiment, the preheat rollers 24 are rotated at the high rotation speed V1 when the job is started.

C5B2: Deceleration-Time Determining Unit

The deceleration-time determining unit C5B2 determines whether or not it is time to change the rotation speed of the preheat rollers 24 from the high rotation speed V1 to the low rotation speed V2. The deceleration-time determining unit C5B2 according to the exemplary embodiment determines that it is time to decelerate when a preset deceleration time t1 has elapsed since the detection of the leading end of the layered body 19 in the transport direction by the sheet sensor SN1. In the exemplary embodiment, the deceleration time t1 is set to a time in which the leading end of the layered body 19 moves from the position of the sheet sensor SN1 to the position of the heat rollers 34 and an amount of bending of the layered body 19 reaches a preset amount.

TM1: Timer

The timer TM1 starts measuring the deceleration time t1 when the sheet sensor SN1 detects the leading end of the layered body 19 in the transport direction.

C5B3: Decelerator

The decelerator C5B3 reduces the rotation speed of the preheat rollers 24 from the high rotation speed V1 to the low rotation speed V2 when the deceleration-time determining unit C5B2 determines that it is time to decelerate.

C5B4: Acceleration-Time Determining Unit

The acceleration-time determining unit C5B4 determines whether or not it is time to change the rotation speed of the preheat rollers 24 from the low rotation speed V2 to the high rotation speed V1. The acceleration-time determining unit C5B4 according to the exemplary embodiment determines that it is time to accelerate when the sheet sensor SN1 detects the trailing end of the layered body 19 in the transport direction.

C5B5: Accelerator

The accelerator C5B5 increases the rotation direction of the preheat rollers 24 from the low rotation speed V2 to the high rotation speed V1 when the acceleration-time determining unit C5B4 determines that it is time to accelerate.

Description of Flowchart of Printer U

The flow of control performed in the printer U according to the exemplary embodiment will be described with reference to a flowchart.

The processes of controlling the temperatures of the heaters 26, 33*a*, and 34*a* and the rotation of the transfer belts 32 according to the exemplary embodiment are well known, and are not illustrated or described in detail herein for simplicity.

Figure 6:
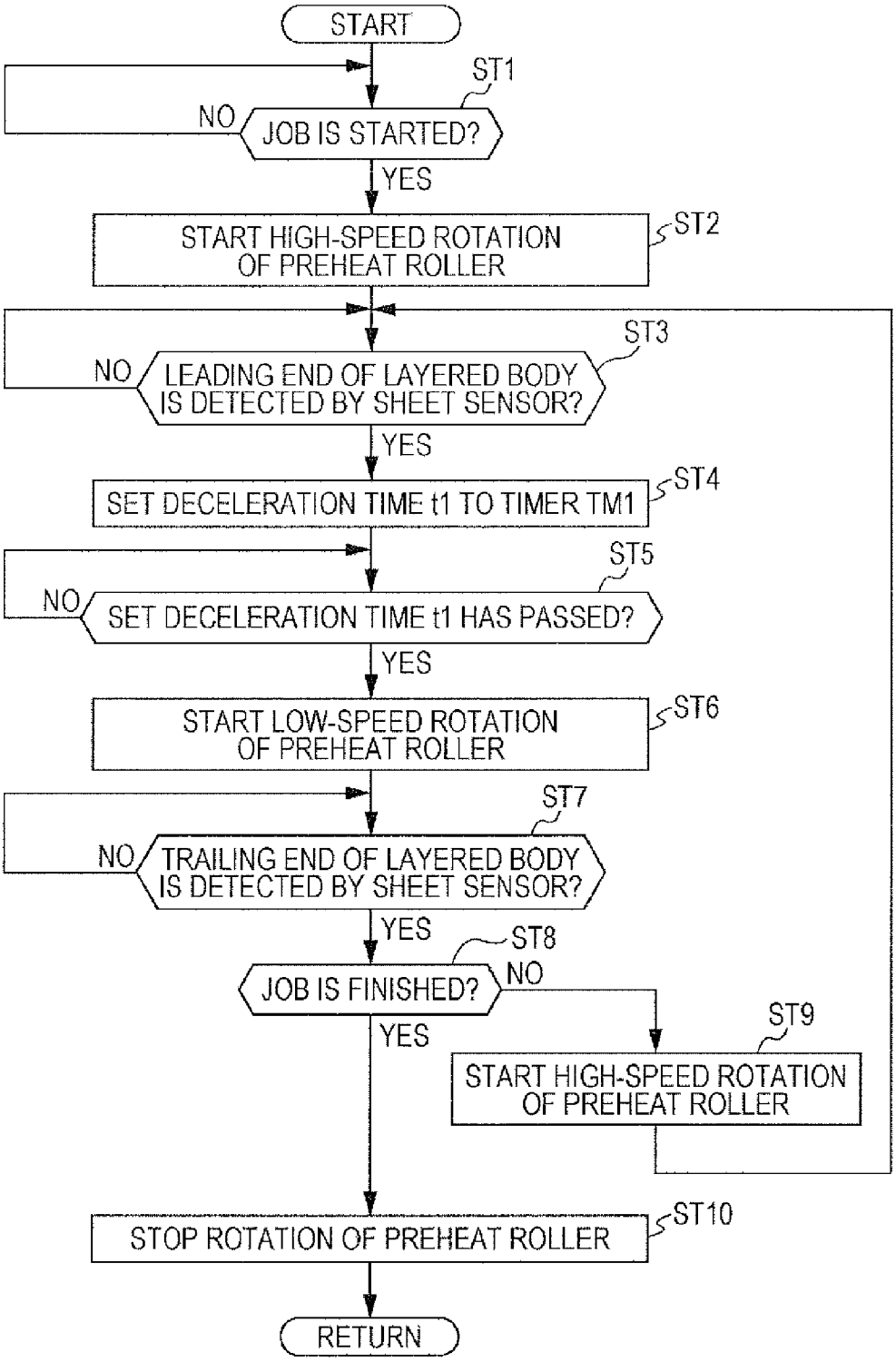
FIG. 6 is a flowchart of a rotation control process for preheat rollers according to the exemplary embodiment.

Description of Flowchart of Rotation Control Process of Preheat Rollers of Exemplary Embodiment FIG. 6 is a flowchart of the rotation control process for the preheat rollers 24 according to the exemplary embodiment.

Each step (ST) of the flowchart of FIG. 6 is performed in accordance with a program stored in the controller C or the like. This process and other processes of the printer U are executed in parallel.

The flowchart of FIG. 6 is started when the power of the printer U is turned on.

In ST1 of FIG. 6, it is determined whether or not a job has been started. If the result of the determination is yes (Y), the process proceeds to ST2. If the result of the determination is no (N), ST1 is repeated.

In ST2, the preheat rollers 24 are rotated at the high rotation speed V1. Then, the process proceeds to ST3.

In ST3, it is determined whether or not the sheet sensor SN1 has detected the leading end of the layered body 19. In other words, it is determined whether or not the status of the sheet determined by the sheet sensor SN1 has been changed from absent to present. If the result of the determination is yes (Y), the process proceeds to ST4. If the result of the determination is no (N), ST3 is repeated.

In ST4, the timer TM1 is set to the deceleration time t1. Then, the process proceeds to ST5.

In ST5, it is determined whether or not the time of the timer TM1 is up, that is, whether or not the deceleration time t1 has elapsed. If the result of the determination is yes (Y), the process proceeds to ST6. If the result of the determination is no (N), ST5 is repeated.

In ST6, the preheat rollers 24 are rotated at the low rotation speed V2. In other words, the rotation speed of the preheat rollers 24 is reduced from the high rotation speed V1 to the low rotation speed V2. Then, the process proceeds to ST7.

In ST7, it is determined whether or not the sheet sensor SN1 has detected the trailing end of the layered body 19. That is, it is determined whether or not it is time to accelerate. If the result of the determination is yes (Y), the process proceeds to ST8. If the result of the determination is no (N), ST7 is repeated.

In ST8, it is determined whether or not the job has been finished. If the result of the determination is no (N), the process proceeds to ST9. If the result of the determination is yes (Y), the process proceeds to ST10.

In ST9, the preheat rollers 24 are rotated at the high rotation speed V1. In other words, the rotation speed of the preheat rollers 24 is increased from the low rotation speed V2 to the high rotation speed V1. Then, the process returns to ST3.

In ST10, the rotation of the preheat rollers 24 is stopped. Then, the process returns to ST1.

Operation of Exemplary Embodiment

In the case where the relay unit U2 and the image transfer device U3 are installed in the printer U according to the exemplary embodiment, when a sheet S of normal paper is output after an image is printed thereon, the sheet S that is transported into the relay unit U2 after the image is printed thereon by the printer body U1 is output to the second output tray 8.

When images are to be recorded on one or both sides of a card base member 7, the printer body U1 prints the images on the image receiving layer or layers 10*b* of the transfer film or films 10 contained in the feed trays TR1 to TR4. The transfer film or films 10 including the image receiving layer or layers 10*b* having the images printed thereon are transported to the collating device U3*a* through the relay unit U2.

Figure 7A:
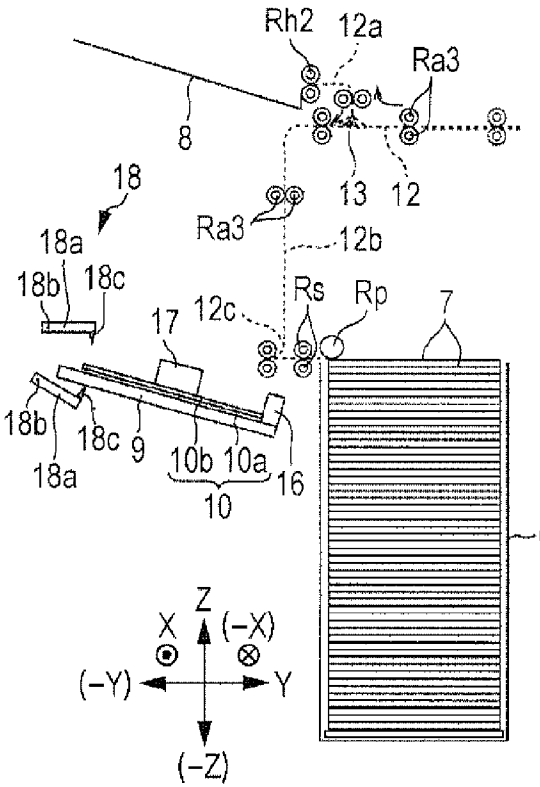
Figure 7B:
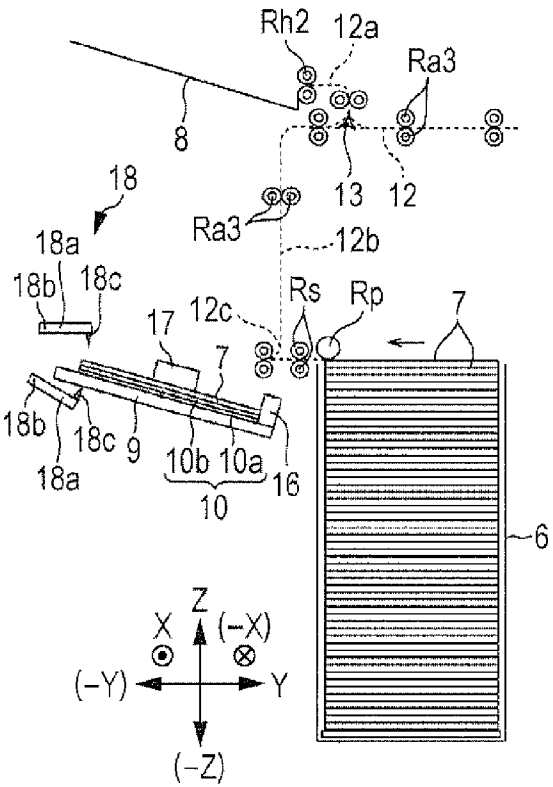
Figure 7C:
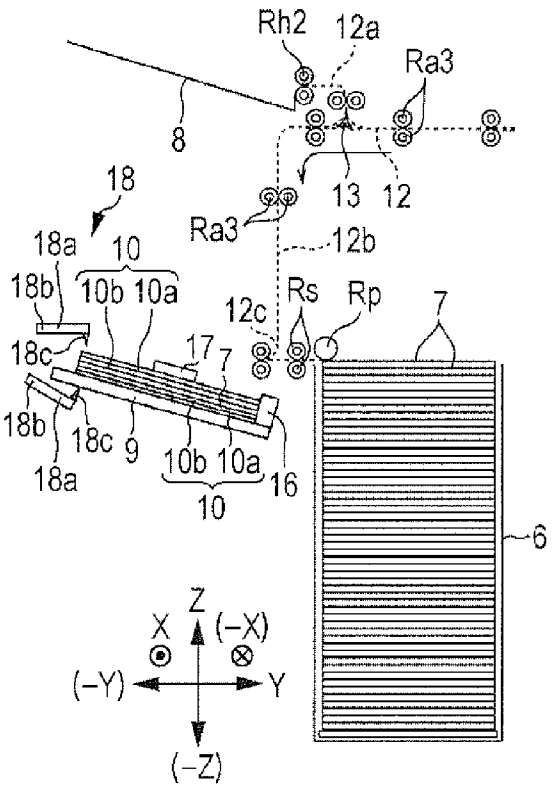

FIGS. 7A to 7C illustrate a case in which images are printed on both sides of a base member according to the exemplary embodiment. FIG. 7A shows a state in which a recording member having an image for a first side printed thereon is placed on a stacking unit. FIG. 7B shows a state in which the base member is stacked on the recording member in the state shown in FIG. 7A. FIG. 7C shows a state in which a recording member having an image for a second side printed thereon is stacked on the base member in the state shown in FIG. 7B.

Referring to FIG. 7A, when images are to be recorded on both sides of a card base member 7, first, a transfer film 10 having an image for a lower side of the card base member 7 recorded thereon is guided by the gate 13 so as to be transported to the ejection path 12*a*. When the trailing end of the transfer film 10 leaves the gate 13, the output rollers Rh2 rotate in the reverse direction so that the transfer film 10 is transported along the ejection path 12*a* in the reverse direction. Thus, a so-called switchback operation is performed. Then, the transfer film 10 is guided by the gate 13 so as to be transported to the stacking path 12*b*. Thus, the transfer film 10 is placed on the compile tray 9 in a state such that the image receiving layer 10*b* faces upward.

Next, as illustrated in FIG. 7B, the card base member 7 is transported from the card tray 6. The card base member 7 that has been transported from the card tray 6 is stacked on the transfer film 10.

Subsequently, when a transfer film 10 having an image for an upper side of the card base member 7 printed thereon is transported into the collating device U3*a*, the gate 13 is switched as illustrated in FIG. 7C. The transfer film 10 is guided by the gate 13 so as to be transported to the stacking path 12*b* without passing through the ejection path 12*a*. Thus, the transfer film 10 having the image for the upper side of the card base member 7 printed thereon is placed on the compile tray 9 in a state such that the image receiving layer 10*b* faces downward and opposes the upper surface of the card base member 7.

In the case where an image is to be recorded on only one side of the card base member 7, only the upper transfer film 10 or the lower transfer film 10 is transported to the compile tray 9 depending on the side of the card base member 7 on which the image is to be recorded.

After the card base member 7 and the transfer films 10 are stacked on the compile tray 9, the provisional fastening devices 18 are activated so as to provisionally fasten the left edge portions of the card base member 7 and the transfer films 10 together by applying heat at two positions. Thus, the card base member 7 and the transfer films 10 are provisionally fastened together as the layered body 19.

The layered body 19 is transported to the encoder unit 20 disposed at a downstream position in the medium transport direction. The encoder unit 20 according to the exemplary embodiment temporarily stops the layered body 19 and reads the information stored in the IC chip with the card reader 20*b*. The layered body 19 that has passed through the encoder unit 20 is transported to the transfer device body U3*b* arranged downstream of the encoder unit 20 in the medium transport direction.

Figure 8:
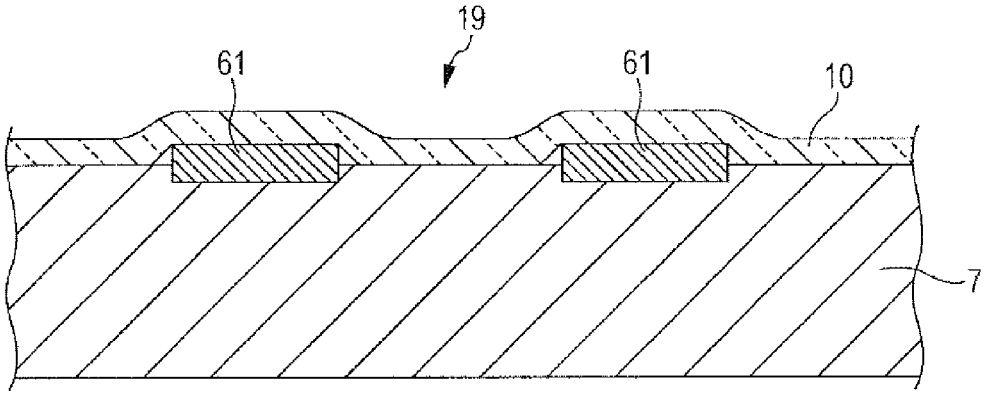
FIG. 8 illustrates the base member onto which an image has been transferred according to the exemplary embodiment.

FIG. 8 illustrates a base member onto which an image has been transferred according to the exemplary embodiment.

Referring to FIGS. 4 and 8, the layered body 19 that has been transported to the transfer device body U3*b* comes into contact with the cleaning rollers 21, which clean the surfaces of the layered body 19. The layered body 19 that has been cleaned by the cleaning rollers 21 is transported to the warming device 23. In the warming device 23, the layered body 19 is sandwiched between the preheat rollers 24 and is thereby heated to a temperature lower than the temperature at which the image printed on the image receiving layer 10*b* of the transfer film 10 may be transferred onto the card base member 7.

The layered body 19 that has been heated by the preheat rollers 24 is transported to the transfer unit 31. In the transfer unit 31, the layered body 19 is pressed and heated by the heat rollers 34 by being sandwiched between the heat rollers 34. Accordingly, toner 61 that has been fixed to the transfer film 10 melts by being heated. In this state, the toner 61 is transferrable from the transfer film 10 to the card base member 7. At this time, the card base member 7 is heated to a temperature higher than or equal to the glass transition temperature thereof, and is therefore softened. When the toner 61 receives a pressure applied by the heat rollers 34, the toner 61 transfers to the card base member 7 in such a manner that a part thereof is embedded into the softened card base member 7, as illustrated in FIG. 8. Thus, the image printed on the image receiving layer 10*b* is transferred onto the surface of the card base member 7.

The layered body 19 including the card base member 7 to which the image has been transferred is transported to the cooling device 41. In the cooling device 41, the layered body 19 is sandwiched and cooled to a temperature lower than or equal to the glass transition temperature. Since the layered body 19 is sandwiched between the transfer belts 32, deformation, such as warping, of the layered body 19 may be suppressed.

After the layered body 19 has passed through the cooling device 41, the layered body 19 is transported to the ejection rollers 51. The ejection rollers 51 eject the layered body 19 to the third output tray 52.

Thus, the card base member 7 having images transferred thereto at one or both sides thereof may be obtained by removing the transfer film or films 10 from the layered body 19 ejected to the output tray 52.

According to the exemplary embodiment, the card base member 7 is heated by the preheat rollers 24 to a temperature lower than the above-described lower temperature limit before the images are transferred onto one or both sides of the card base member 7 by the heat rollers 34.

In a structure according to the related art in which the preheat rollers 24 are not provided, the layered body 19 is inserted between the heat rollers 34 without being heated. When the layered body 19 is inserted between the heat rollers 34 without being heated, a large amount of heat of the heat rollers 34 is absorbed by the cool layered body 19. Therefore, when plural layered bodies 19 are successively subjected to the transferring process at short intervals or when the layered body 19 is large or thick, there is a risk that the heat of the heat rollers 34 will be insufficient for the transferring process. When the transferring process is repeated at short intervals, there is a risk that the temperature of the heat rollers 34 will be gradually reduced and the temperature necessary for the transferring process cannot be ensured. When the layered body 19 is large or thick, a large amount of heat is absorbed by an upstream portion of the layered body 19 in the medium transport direction, and sufficient heat may not be transmitted to a downstream portion of the layered body 19. Thus, there is a risk that a temperature difference will occur between the upstream and downstream portions of the layered body 19. Accordingly, there is a risk that the images will be non-uniformly transferred onto the card base member 7 and a transfer failure will occur.

In contrast, according to the exemplary embodiment, the layered body 19 is heated by the preheat rollers 24, which are arranged immediately upstream of the heat rollers 34.

Therefore, the amount of heat of the heat rollers 34 absorbed by the layered body 19 is smaller than that in the structure of the related art in which the images are transferred onto the card base member 7 of the layered body 19 that has not been heated. Thus, in the structure according to the exemplary embodiment, the risk that the heat of the heat rollers 34 will be insufficient in the process of transferring the images onto the card base member 7 of the layered body 19 may be reduced. Accordingly, the occurrence of a transfer failure may be reduced. In particular, in the exemplary embodiment, the auxiliary heat rollers 33 heat the transfer belts 32 at locations upstream of the heat rollers 34. Therefore, compared to the case in which the auxiliary heat rollers 33 are not provided, the risk that the amount of heat will be insufficient is further reduced.

If the layered body 19 is heated by the preheat rollers 24 to a temperature higher than the above-described lower temperature limit, the transferring process is performed twice by the preheat rollers 24 and the heat rollers 34. When the transferring process is performed twice, the toner that has once been melted and transferred is heated again. Accordingly, there is a risk that toners of respective colors forming dots in an image will melt at a high temperature and be mixed with toners forming the adjacent dots, thereby causing discoloration. In addition, there is also a risk that the toners will flow and cause a transfer failure such as bleeding and blurring.

In contrast, according to the exemplary embodiment, the layered body 19 is heated by the preheat rollers 24 to a temperature lower than the lower temperature limit, so that images are prevented from being transferred onto the card base member 7 of the layered body 19 by the preheat rollers 24.

Thus, according to the exemplary embodiment, images are not transferred onto the card base member 7 of the layered body 19 twice by the preheat rollers 24 and the heat rollers 34, and the occurrence of a transfer failure in the process of transferring the images onto the card base member 7 may be reduced.

If the layered body 19 is heated by the preheat rollers 24 to a temperature higher than the glass transition temperature of the card base member 7, the card base member 7 that has passed between the preheat rollers 24 is softened. When the card base member 7 is softened, there is a risk that the layered body 19 will be deformed so as to sag downward after passing between the preheat rollers 24. Accordingly, there is a possibility that transportation stability will be reduced and a transport failure will occur. Also, if the card base member 7 that has been softened by the preheat rollers 24 receives a pressure when the card base member 7 passes between the heat rollers 34, there is a risk that the card base member 7 will be stretched in a horizontal direction and be deformed.

Furthermore, if the temperature of the layered body 19 becomes close to 90° C., which is the lower temperature limit, there is a risk that incomplete transfer will be started.

In contrast, according to the exemplary embodiment, the preheat rollers 24 heat the layered body 19 to a temperature lower than the transition temperature of the card base member 7. Therefore, the risk that the card base member 7 will be softened by the preheat rollers 24 may be reduced. The layered body 19 passes between the preheat rollers 24 and is transported to the heat rollers 34 in a hard state without being softened. Thus, according to the exemplary embodiment, the risk that a transport failure or deformation of the layered body 19 will occur may be reduced.

According to the exemplary embodiment, the preheat rollers 24 heat the layered body 19 to a temperature lower than the glass transition temperature of the card base member 7, which is lower than the above-described lower temperature limit. Thus, the preheat rollers 24 heat the layered body 19 to a temperature that is sufficiently lower than the lower temperature limit, and the risk that incomplete transfer will occur may be reduced. As a result, the occurrence of a transfer failure in the process of transferring the images onto the card base member 7 may be reduced.

Figure 9A:
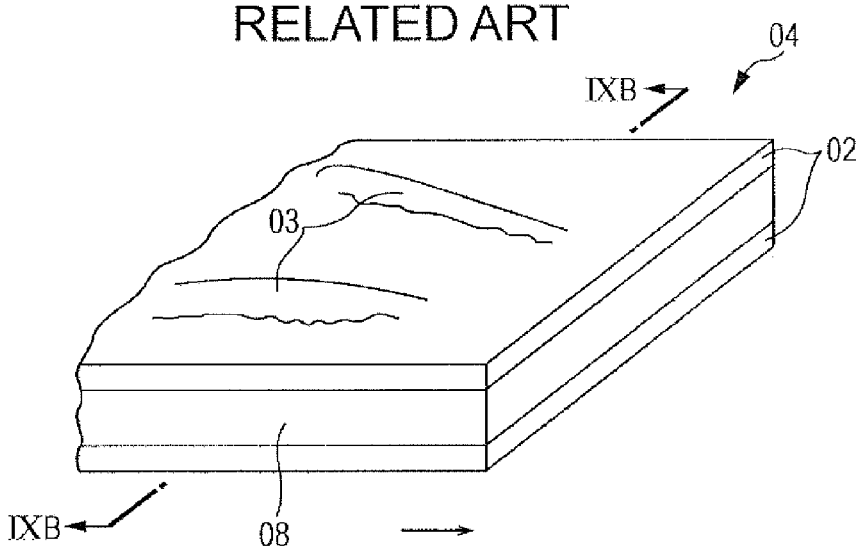
FIG. 9A RELATED ART
FIGS. 9A and 9B are a perspective view and a sectional view of FIG. 9A taken along line IXB-IXB, respectively, illustrating a state in which wrinkles are formed on a transfer film according to the related art.
Figure 9B:
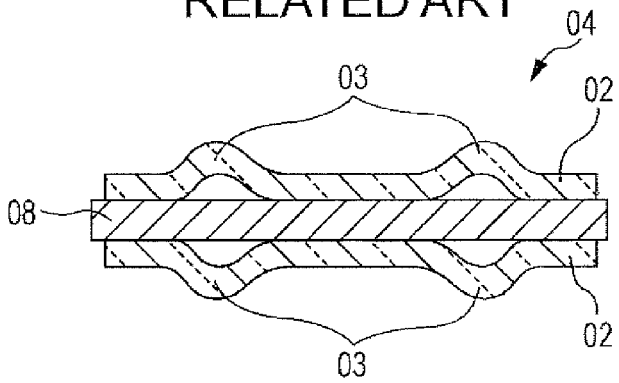
FIG. 9B RELATED ART

FIGS. 9A and 9B are a perspective view and a sectional view of FIG. 9A taken along line IXB-IXB, respectively, illustrating a state in which wrinkles are formed on a transfer film according to the related art.

The layered body 19 that has passed between the preheat rollers 24 is transported to the heat rollers 34. In the exemplary embodiment, the transport speed of the preheat rollers 24 is higher than that of the heat rollers 34 at the time when the layered body 19 is inserted between the heat rollers 34.

According to the related art, to maintain the state in which the card base member 7 and the transfer film or films 10 are stacked together, the speed at which the preheat rollers 24 transport the layered body 19 is set so as to be lower than or equal to the speed at which the heat rollers 34 transport the layered body 19. However, as illustrated in FIGS. 9A and 9B, in the structure of the related art, wrinkles 03 are sometimes formed on transfer films 02 that have passed between heat rollers. Although the principle and mechanism of formation of the wrinkles 03 is not known, the following two hypotheses are proposed.

Figure 10A:
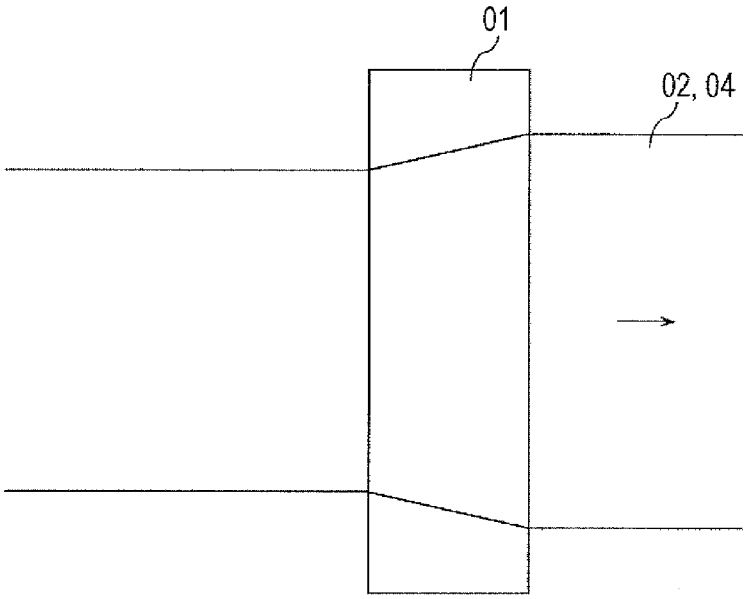
FIG. 10A RELATED ART
FIGS. 10A and 10B illustrate a first hypothetical principle and a second hypothetical principle, respectively, of the formation of wrinkles on a transfer film according to the related art.
Figure 10B:
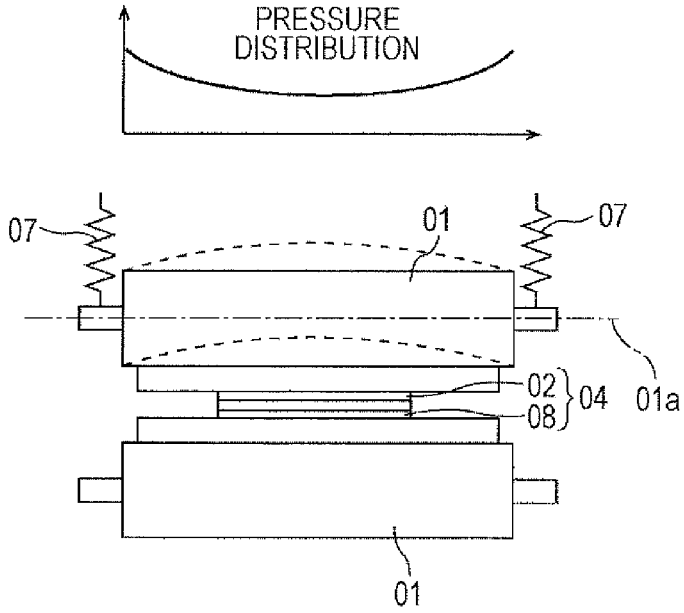
FIG. 10B RELATED ART

FIGS. 10A and 10B illustrate a first hypothetical principle and a second hypothetical principle, respectively, of the formation of the wrinkles 03 on the transfer films 02 according to the related art.

Referring to FIG. 10A, when a layered body 04 passes between heat rollers 01, the layered body 04 thermally expands in a width direction thereof. The first hypothesis is that the wrinkles 03 are formed owing to the difference in dimension in the width direction in the state in which the layered body 04 is sandwiched by the heat rollers 01.

Referring to FIG. 10B, the heat rollers 01 are cylindrical members, and are pressed against each other by springs 06 at both ends thereof in the axial direction. Therefore, when the heat rollers 01 are in contact with each other, the heat rollers 01 are bent such that portions thereof in a central region in the axial direction, in which the springs 06 are not disposed, move away from each other. Accordingly, the distance from a rotation center 01*a* to the outer periphery of each heat roller 01 is smaller in the central region than at both ends. Therefore, the peripheral speed in the central region differs from that at both ends, and the transport speed of the transfer films 02 is high at both ends and low in the central region. The second hypothesis is that the wrinkles 03 are formed because the transfer films 02 receive a shear force between the central region and both ends.

Thus, according to the related art, there is a possibility that the wrinkles 03 will be formed, although the detailed principle is not known. If the wrinkles 03 are formed, there is a risk that a transfer failure will occur in which, for example, the image cannot be transferred onto a card base member 08 in regions where the wrinkles 03 are formed, the image is displaced, or the transferred image is scraped off by the force by which the transfer film 02 is deformed when the wrinkles 03 are formed thereon.

Figure 11A:
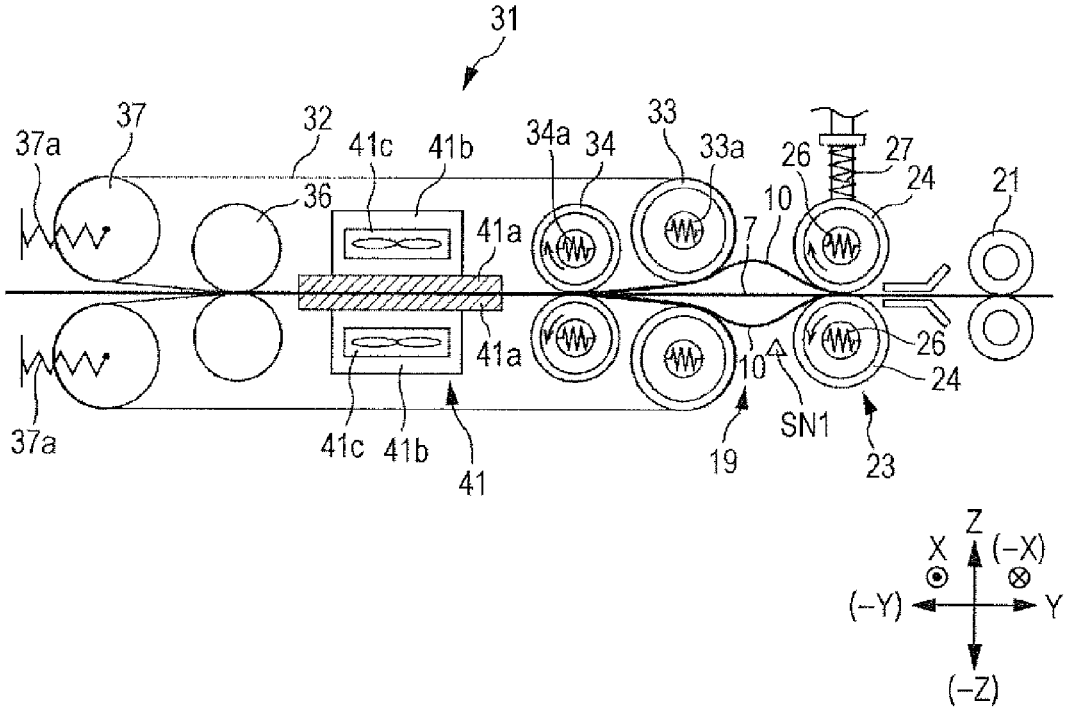
FIGS. 11A and 11B illustrate a state in which a layered body according to the exemplary embodiment extends between a transport unit and a transfer unit, wherein FIG. 11A corresponds to FIG. 4
Figure 11B:
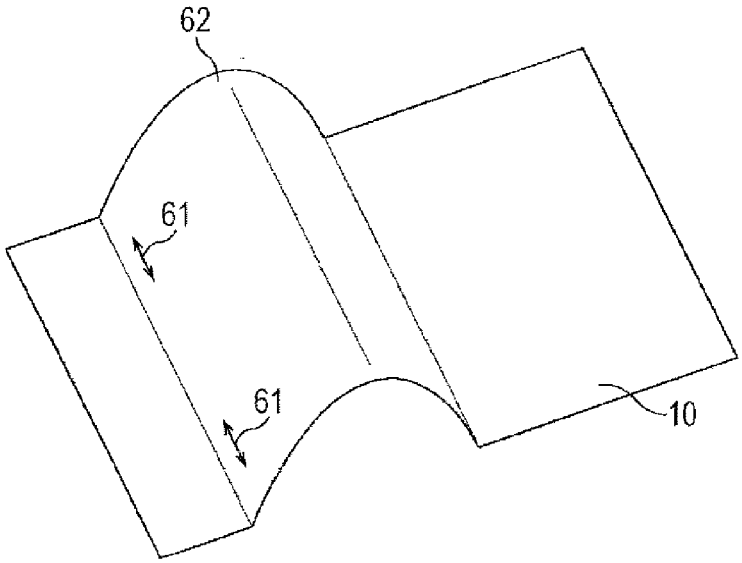

FIGS. 11A and 11B illustrate the state in which the layered body according to the exemplary embodiment extends between the transport unit and the transfer unit, wherein FIG. 11A corresponds to FIG. 4 and FIG. 11B is a perspective view of a transfer film in a bent state.

In the exemplary embodiment, the transport speed of the preheat rollers 24 is higher than that of the heat rollers 34. Owing to the speed difference between the heat rollers 34 and the preheat rollers 24, the transfer films 10 with which the preheat rollers 24 are in contact are bent with respect to the card base member 7 by being pushed by the preheat rollers 24, as illustrated in FIGS. 11A and 11B. Referring to FIG. 11B, in the state in which each transfer film 10 is bent into a curve with respect to the transport direction of the layered body 19, even when a bending force that causes wrinkles 03 is applied in the width direction of the layered body 19 shown by the arrows 61, the transfer film 10 is not easily bent in the width direction owing to a curved portion 62 thereof that is curved with respect to the transport direction. Therefore, in the image transfer device U3 according to the exemplary embodiment, wrinkles are not easily formed on the transfer films 10, and the occurrence of a transfer failure may be reduced.

In particular, in the exemplary embodiment, the transfer films 10 and the card base member 7 are provisionally fastened together, and are transported without being displaced from each other at the leading edges thereof. The layered body 19 is sandwiched between the transfer belts 32 at the location of the heat rollers 34. Therefore, even though each transfer film 10 becomes separated from the card base member 7 when the curved portion 62 is formed, the transfer film 10 is stacked on the card base member 7 again without a displacement when the transferring process is performed.

In the exemplary embodiment, after the deceleration time t1 elapses, the rotation speed of the preheat rollers 24 is reduced so that the transport speed of the layered body 19 becomes equal to or substantially equal to the transport speed at the heat rollers 34. If the preheat rollers 24 are not decelerated, the size of the curved portion 62 of each transfer film 10 keeps increasing until the trailing end of the transfer film 10 leaves the preheat rollers 24. As a result, there is a risk that the curved portion 62 will be excessively large. In contrast, in the exemplary embodiment, the size of the curved portion 62 increases to the size corresponding to the deceleration time t1. After that, the size of the curved portion 62 is maintained between the preheat rollers 24 and the heat rollers 34. Thus, the curved portion 62 is prevented from becoming excessively large.

In the exemplary embodiment, as illustrated in FIG. 11A, the transfer films 10 in a bent state approaches the respective transfer belts 32, which are heated by the auxiliary heat rollers 33, at locations upstream of the heat rollers 34. Therefore, compared to the case in which the transfer films 10 do not approach the respective transfer belts 32, the temperature of the transfer films 10 that have been heated by the preheat rollers 24 less easily decreases. Therefore, the risk that the heat applied by the heat rollers 34 will be insufficient may be further reduced.

When the transfer films 10 are bent, there is a possibility that the preheat rollers 24 will come into contact with the card base member 7 after the trailing ends of the transfer films 10 in the transport direction have left the preheat rollers 24. In this case, since the preheat rollers 24 and the heat rollers 34 transport the card base member 7 at the same transport speed in the exemplary embodiment, the card base member 7 does not receive a bending force. Even when the rollers 24 and 34 have different transport speeds owing to wear or the like over time, the card base member 7 is not easily bent since the contact pressure applied between the preheat rollers 24 is set so as to be low enough to prevent the card base member 7 from being bent in the exemplary embodiment.

Modifications

Although the exemplary embodiment of the present invention is described in detail above, the present invention is not limited to the above-described exemplary embodiment, and various modifications are possible within the scope of the present invention defined by the claims. Modifications (H01) to (H010) of the present invention will now be described.

(H01) Although the printer U is described as an example of an image forming apparatus in the exemplary embodiment, the image forming apparatus is not limited to this, and may instead be, for example, a copy machine, a facsimile machine, or a multifunction machine having the functions of these machines. The image forming apparatus is also not limited to an electrophotographic image forming apparatus, and may be an image forming apparatus of any image formation method, such as an inkjet recording image forming apparatus, a thermal head image forming apparatus, or a lithographic printer. Furthermore, the image forming apparatus is also not limited to a multicolor image forming apparatus, and may instead be a single-color or monochrome image forming apparatus. The image forming apparatus is also not limited to a so-called tandem-type image forming apparatus, and may instead be a rotary-type image forming apparatus.

(H02) Although the collating device U3*a* that provisionally fastens the leading edges of the sheets S together is described in the exemplary embodiment, the present invention is not limited to this. For example, the function of provisionally fastening the leading edges of the sheets S together may be omitted when the card base member 7 and the transfer film or films 10 are, for example, nipped between rollers and are not easily displaced from each other. Furthermore, the collating device U3*a* may be omitted, and the card base member 7 and the transfer film or films 10 may be transported from the relay unit U2 in a stacked state.

(H03) Although the warming device 23 including the pair of roll-shaped preheat rollers 24 is described as an example of a warming member in the exemplary embodiment, the warming member is not limited to this. For example, belt-shaped warming portions may be used instead of the roll-shaped preheat rollers 24 as long as, for example, a structure for suppressing meandering of the belt-shaped warming portions and a cleaning member that allows generation of metal powder or removes the metal powder are provided. Plural pairs of preheat rollers 24 may be arranged in the medium transport direction, and the temperatures of the pairs of preheat rollers 24 may be set so as to increase stepwise from the upstream side toward the downstream side in the medium transport direction.

(H04) In the exemplary embodiment, the contact pressure of the heat rollers 34 is desirably higher than that of the preheat rollers 24. However, the contact pressure of the heat rollers 34 may instead be lower than or equal to that of the preheat rollers 24 depending on, for example, the settings of the rotation speeds of the preheat rollers 24 and the heat rollers 34, coefficients of friction of the surfaces of the preheat rollers 24 and the heat rollers 34, etc., and specifications.

(H05) Although the transfer unit 31 includes the transfer belts 32 in the exemplary embodiment, the present invention is not limited to this. For example, the transfer belts 32 may be omitted and, similar to the preheat rollers 24, only a pair of heat rollers may be provided.

(H06) Although the heat sinks 41*b* that contact the respective transfer belts 32 are illustrated as an example of cooling units in the exemplary embodiment, the cooling units are not limited to this. For example, a pair of roll-shaped cooling rollers may instead be used. In this case, heaters at a temperature lower than that of the heaters 34*a* of the heat rollers 34 may be disposed in the respective cooling rollers to prevent formation of irregular portions, that is, so-called sink marks on the card base member due to rapid cooling. Furthermore, plural pairs of cooling rollers may be provided to perform the cooling in a stepwise manner. In this case, the temperatures of the heaters disposed in the cooling rollers may be set so as to decrease stepwise from the upstream side toward the downstream side.

(H07) Although the rotation speed of the preheat rollers 24 is desirably reduced after the deceleration time t1 has elapsed in the exemplary embodiment, the present invention is not limited to this. In other words, the rotation speed may be maintained at the high rotation speed. Alternatively, a sensor that measures an amount of bending may be provided, and the rotation speed of the preheat rollers 24 may be controlled so that the amount of bending becomes equal to a preset amount.

(H08) Although the heaters 26 and 34*a* are provided in both of the preheat rollers 24 and both of the heat rollers 34, respectively, in the exemplary embodiment, the present invention is not limited to this. For example, the heaters 26 and 34*a* may instead be provided in only one of the preheat rollers 24 and only one of the heat rollers 34, respectively. Alternatively, the heat rollers may be heated by bringing rotary members having heaters into contact with the heat rollers and causing the heat of the heaters to be transmitted to the heat rollers.

(H09) Although the auxiliary heat rollers 33 having the heating function are provided in the exemplary embodiment, the present invention is not limited to this. For example, the auxiliary heat rollers 33 having the heating function may be omitted.

(H010) The numerical values, etc., specified in the exemplary embodiment may be changed as appropriate in accordance with, for example, the design and specifications.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image transfer device comprising:

a transfer unit that heats a layered body including a recording member, which is flexible and has an image recorded on a recording surface thereof, and a base member, onto which the image on the recording member is to be transferred, to transfer the image recorded on the recording surface onto the base member, the transfer unit transporting the layered body by rotating while being in contact with a back surface of the recording member on a side opposite to the side of the recording surface; and a transport unit disposed upstream of the transfer unit in a transport direction of the layered body, the transport unit rotating while being in contact with the back surface of the recording member to transport the layered body to the transfer unit.

2. The image transfer device according to claim 1, wherein the transport unit transports the layered body to the transfer unit at a transport speed higher than a transport speed at which the transfer unit transports the layered body.

3. The image transfer device according to claim 2, further comprising:

a control unit that reduces the transport speed at which the transport unit transports the layered body from the speed higher than the transport speed at which the transfer unit transports the layered body to a speed substantially equal to the transport speed at which the transfer unit transports the layered body after a preset time since a leading end of the layered body in a transport direction of the layered body has reached the transfer unit.

4. The image transfer device according to claim 3, wherein the transfer unit includes a pair of endless rotary members that rotate, a pair of first rotary members that support the respective endless rotary members in a rotatable manner, and a first heat source disposed in at least one of the first rotary members, and wherein the transfer unit transports the layered body by sandwiching the layered body between the endless rotary members while heating the layered body.

5. The image transfer device according to claim 4, wherein the transport unit includes a pair of second rotary members that rotate, and a second heat source disposed in at least one of the second rotary members, and wherein the transport unit heats the layered body to a temperature lower than a lower temperature limit at which the image is capable of being transferred from the recording member onto the base member.

6. The image transfer device according to claim 2, wherein the transfer unit includes a pair of endless rotary members that rotate, a pair of first rotary members that support the respective endless rotary members in a rotatable manner, and a first heat source disposed in at least one of the first rotary members, and wherein the transfer unit transports the layered body by sandwiching the layered body between the endless rotary members while heating the layered body.

7. The image transfer device according to claim 6, wherein the transport unit includes a pair of second rotary members that rotate, and a second heat source disposed in at least one of the second rotary members, and wherein the transport unit heats the layered body to a temperature lower than a lower temperature limit at which the image is capable of being transferred from the recording member onto the base member.

8. The image transfer device according to claim 1, wherein the transfer unit includes a pair of endless rotary members that rotate, a pair of first rotary members that support the respective endless rotary members in a rotatable manner, and a first heat source disposed in at least one of the first rotary members, and wherein the transfer unit transports the layered body by sandwiching the layered body between the endless rotary members while heating the layered body.

9. The image transfer device according to claim 8, wherein the transport unit includes a pair of second rotary members that rotate, and a second heat source disposed in at least one of the second rotary members, and wherein the transport unit heats the layered body to a temperature lower than a lower temperature limit at which the image is capable of being transferred from the recording member onto the base member.

10. An image forming apparatus comprising:

a recording unit that records an image on a recording member; and the image transfer device according to claim 1 which transfers the image recorded on the recording member onto the base member.

* * * * *